US011094493B2

(12) United States Patent
Ebersohn et al.

(10) Patent No.: US 11,094,493 B2
(45) Date of Patent: Aug. 17, 2021

(54) EMITTER STRUCTURES FOR ENHANCED THERMIONIC EMISSION

(71) Applicant: Lockheed Martin Corporation, Bethesda, MD (US)

(72) Inventors: Frans Hendrik Ebersohn, Palmdale, CA (US); Randall James Sovereign, Palmdale, CA (US); Jonathon Robert Heinrich, Albuquerque, NM (US); Regina Mariko Sullivan, Palmdale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 16/529,409

(22) Filed: Aug. 1, 2019

(65) Prior Publication Data

US 2021/0035765 A1 Feb. 4, 2021

(51) Int. Cl.
*H01J 1/148* (2006.01)
*H01J 9/04* (2006.01)

(52) U.S. Cl.
CPC ..... *H01J 1/148* (2013.01); *H01J 9/042* (2013.01); *H01J 2201/196* (2013.01)

(58) Field of Classification Search
CPC .... H01J 1/13; H01J 1/148; H01J 9/042; H01J 2201/196
See application file for complete search history.

(56) References Cited

U.S. PATENT DOCUMENTS 3,238,395 A 3/1966 Sense
3,437,865 A * 4/1969 Albert ..... H01J 9/042 313/346 R
3,578,992 A 5/1971 Paine
3,719,855 A * 3/1973 Staffa ..... H01J 1/28 313/338
3,928,783 A * 12/1975 Hosoki ..... H01J 1/20 313/270
4,633,129 A * 12/1986 Cuomo ..... H01J 1/025 313/103 CM
4,734,073 A * 3/1988 Smith ..... H01J 1/13 313/346 DC
4,795,940 A 1/1989 Leung et al.
(Continued)

FOREIGN PATENT DOCUMENTS

DE 4421793 1/1996
EP 1 347 486 A1 9/2003
(Continued)

OTHER PUBLICATIONS

U.S. Appl. No. 10/026,582, Jul. 17, 2018, Kohei Sasai et al.
(Continued)

*Primary Examiner* — Donald L Raleigh
(74) *Attorney, Agent, or Firm* — Baker Botts L.L.P.

(57) ABSTRACT

In one embodiment, a system includes a cathode and a thermionic emitter installed at least partially within the cathode tube of the cathode. The thermionic emitter is in a shape of a hollow cylinder. The hollow cylinder includes an outer surface and an unsmooth inner surface. The outer surface is configured to contact an inner surface of the cathode tube. The unsmooth inner surface includes a plurality of structures that provide an increase in surface area over a smooth surface.

15 Claims, 5 Drawing Sheets

(56) References Cited

U.S. PATENT DOCUMENTS

| | | | | |
|---|---|---|---|---|
| 5,063,324 | A * | 11/1991 | Grunwald | H01J 1/28 313/346 DC |
| 5,219,516 | A * | 6/1993 | Horner-Richardson | G21D 7/04 376/321 |
| 6,822,241 | B2 | 11/2004 | Schut et al. | |
| 7,412,033 | B2 | 8/2008 | Freudenberger | |
| 7,915,797 | B2 | 3/2011 | Liu et al. | |
| 7,982,382 | B2 | 7/2011 | Liu et al. | |
| 8,227,970 | B2 | 7/2012 | Freudenberger | |
| 8,254,526 | B2 | 8/2012 | Hauttmann | |
| 8,410,675 | B2 | 4/2013 | Liu et al. | |
| 2008/0029145 | A1 | 2/2008 | Sung | |
| 2008/0203885 | A1* | 8/2008 | Ono | H01J 1/16 313/310 |
| 2014/0097736 | A1* | 4/2014 | Katsap | H01J 1/14 313/37 |
| 2014/0097741 | A1* | 4/2014 | Guo | H01J 1/304 313/310 |
| 2014/0139100 | A1* | 5/2014 | Kobayashi | H01J 1/148 313/346 R |
| 2017/0367168 | A1* | 12/2017 | McDonald | H01J 37/32596 |
| 2020/0066474 | A1* | 2/2020 | Lorr | H01J 9/042 |

FOREIGN PATENT DOCUMENTS

| | | | | |
|---|---|---|---|---|
| JP | S 5661732 | A * | 5/1981 | H01J 1/20 |
| WO | WO 2014/020598 | A1 | 2/2014 | |
| WO | WO-2019215335 | A1 * | 11/2019 | H05H 1/46 |

OTHER PUBLICATIONS

PCT Search Report re PCT/US2020/040974, dated Sep. 30, 2020.
KIPO's Notice of Last Preliminary Rejection Re KR 10-2015-7031314 (with English translation), dated Nov. 24, 2020.

* cited by examiner

EMITTER STRUCTURES FOR ENHANCED THERMIONIC EMISSION

TECHNICAL FIELD

This disclosure generally relates to thermionic emission and more specifically to emitter structures for enhanced thermionic emission.

BACKGROUND

Thermionic emitters are critical components of cathodes that are used, for example, in electron sources, plasma sources, and electric propulsion devices for spacecraft (e.g., ion thrusters). High heat (e.g., over 1600 degrees Celsius) is applied to thermionic emitters in order to emit electrons from surfaces of the thermionic emitter. The total current emitted by a thermionic emitter is determined by the temperature of the emitter and the surface area. Higher temperatures and larger surface area thermionic emitters lead to more emitted current. However, higher temperatures add significant thermal challenges, and larger thermionic emitters are not desirable or compatible with certain applications.

SUMMARY OF PARTICULAR EMBODIMENTS

In one embodiment, a system includes a cathode and a thermionic emitter installed at least partially within the cathode tube of the cathode. The thermionic emitter is in a shape of a hollow cylinder. The hollow cylinder includes an outer surface and an unsmooth inner surface. The outer surface is configured to contact an inner surface of the cathode tube. The unsmooth inner surface includes a plurality of structures that provide an increase in surface area over a smooth surface.

In another embodiment, a system includes a cathode and a thermionic emitter installed at least partially within the cathode tube of the cathode. The thermionic emitter is in a shape of a hollow cylinder. The hollow cylinder includes an outer surface and an inner surface. The inner surface includes a plurality of structures extending below or above the inner surface.

In another embodiment, a thermionic emitter includes a first surface and a second surface that is opposite the first surface. The thermionic emitter further includes a plurality of structures that each extend below or above the first surface.

The present disclosure provides numerous technical advantages over typical systems. As one example, the disclosed systems include thermionic emitters that each have a emitting surface that includes structures that each extend below or above the emitting surface. The structures, which for example may be ridges and/or troughs, function to increase the surface area of the emitting surface, thereby increasing the amount of electrons emitted by the emitting surface. This may permit a thermionic emitter to be operated at colder temperatures than a typical thermionic emitter of identical size but still produce the same current. As a result, the functional lifetime of the thermionic emitter may be extended. In addition, a thermionic emitter with the disclosed surface structures will produce more current than a typical thermionic emitter of identical size that is operated at the same temperature. As a result, the performance of devices that utilize such thermionic emitters may be increased without having to increase the temperature of the devices. In some embodiments, the surface structures also intercept radiated power from other nearby surfaces which may improve performance compared to non-structured surfaces with similar surface area. Surface structures may also be designed to produce a more uniform emitted current as the thermionic emitter evaporates and the inner surface shape alters.

Other technical advantages will be readily apparent to one skilled in the art from the following figures, descriptions, and claims. Moreover, while specific advantages have been enumerated herein, various embodiments may include all, some, or none of the enumerated advantages.

DESCRIPTION OF EXAMPLE EMBODIMENTS

Thermionic emitters are used to emit electron currents critical for many different plasma devices. For example, thermionic emitters are critical components of cathodes that are used in electron sources, plasma sources, and electric propulsion devices for spacecraft (e.g., ion thrusters). Thermionic emitters must be heated to extremely high temperature (e.g., ~1600 degrees Celsius) in order to emit sufficient electron currents. Higher temperatures lead to more electron emission, higher achievable currents, and better plasma device performance. However, increasing the amount of temperature of a thermionic emitter is not always desirable or feasible in order to increase electron emission.

To address these and other challenges with typical thermionic emitters, the disclosure provides various embodiments of thermionic emitters that each include structures that each extend below or above the emitting surface of the thermionic emitter. The structures, which for example may be ridges and/or troughs, function to increase the surface area of the emitting surface, thereby increasing the amount of electrons emitted by the emitting surface. This may permit a thermionic emitter with the disclosed structures to be operated at colder temperatures than a typical thermionic emitter of identical size but still obtain the same current. As a result, the functional lifetime of the thermionic emitter may be extended. In addition, a thermionic emitter with the disclosed surface structures will produce more current than a typical thermionic emitter of identical size that is operated at the same temperature. As a result, the performance of devices that utilize such thermionic emitters may be increased. In certain embodiments, the surface structures also may have the added benefit of intercepting radiated power from other nearby surface structures, reducing some of the heat lost. Surface structures may also be designed to give a certain current emission profile as the emitter surface evaporates during the lifetime of the thermionic emitter.

To facilitate a better understanding of the present disclosure, the following examples of certain embodiments are given. In no way should the following examples be read to limit, or define, the scope of the disclosure. Embodiments of the present disclosure and its advantages may be best understood by referring to the included FIGURES, where like numbers are used to indicate like and corresponding parts.

Figure 1:
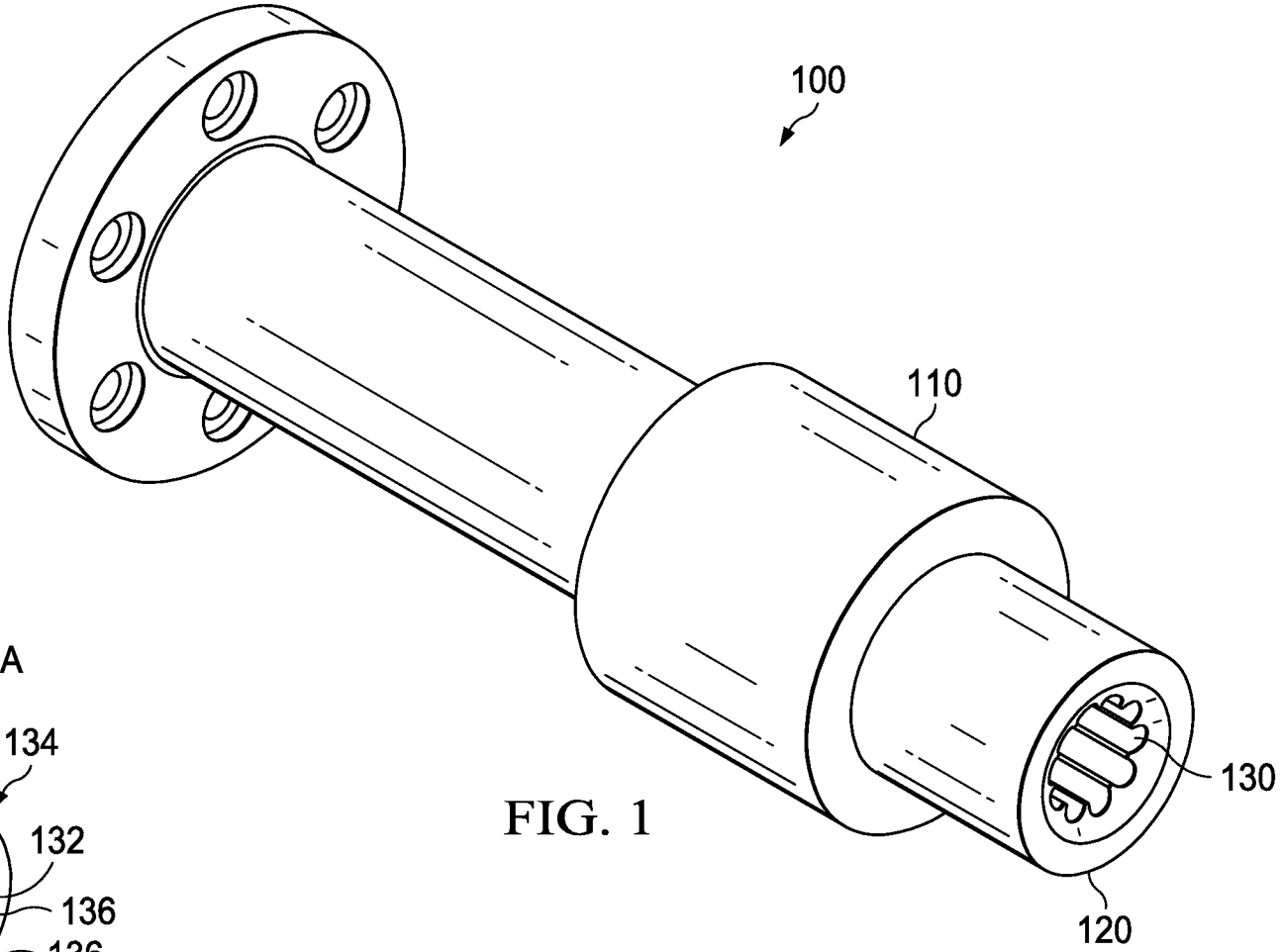
FIG. 1 illustrates an example cathode, according to certain embodiments.

FIG. 1 illustrates an example cathode 100, in accordance with embodiments of the present disclosure. In some embodiments, cathode 100 includes a heater 110, a cathode tube 120, and a thermionic emitter 130 that is installed either partially or fully within cathode tube 120. In some embodiments, heater 110 partially or fully surrounds cathode tube 120. In other embodiments, heater 110 may be integrated within cathode tube 120.

In general, cathode 100 may be used in a device such as an electron source, plasma source, or electric propulsion device for a spacecraft (e.g., an ion thruster). Heater 110 heats thermionic emitter 130 in order to create electron currents from thermionic emitter 130 to be used in a plasma devices such as an ion thruster. As described in more detail below, thermionic emitter 130, unlike typical thermionic emitters, includes an emitting surface with structures that function to increase the surface area of the emitting surface. By increasing the surface are of the emitting surface, the structures enable thermionic emitter 130 to emit a greater amount of electrons than an identical thermionic emitter with a smooth emitting surface.

Figure 2:
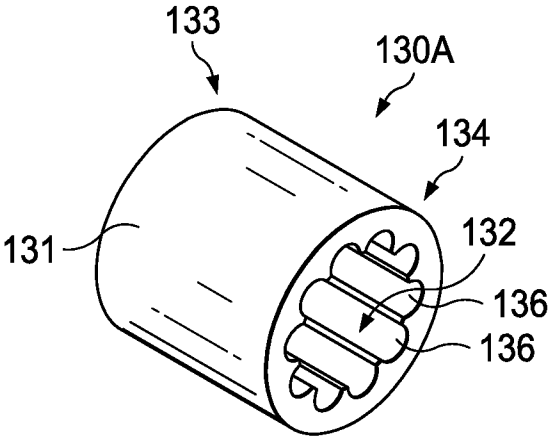
FIG. 2 illustrates an example thermionic emitter that may be used with the cathode of FIG. 1, according to certain embodiments.
Figure 3C:
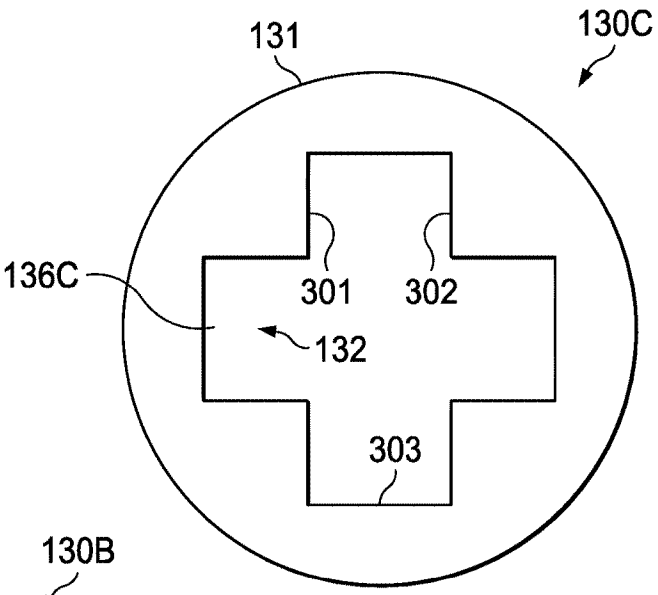
FIGS. 3B-3F illustrate cross-sectional views of various embodiments of the thermionic emitter of FIG. 1, according to certain embodiments.
Figure 3B:
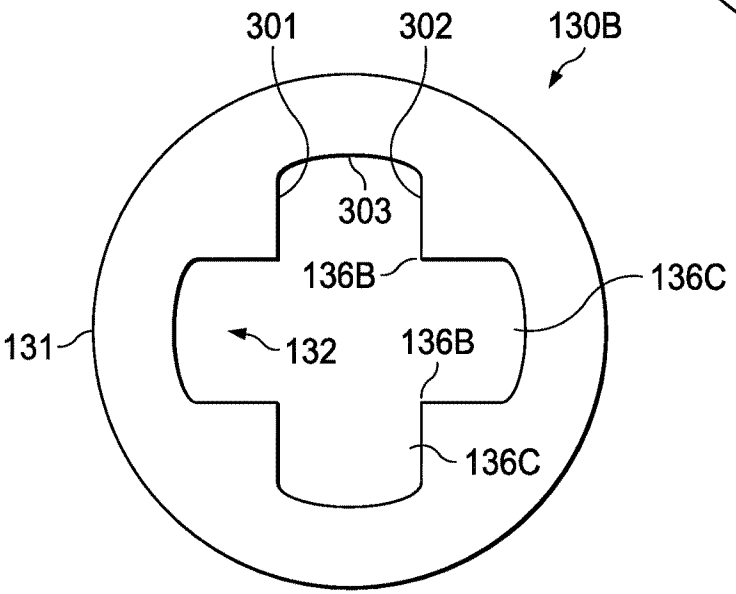
Figure 3A:
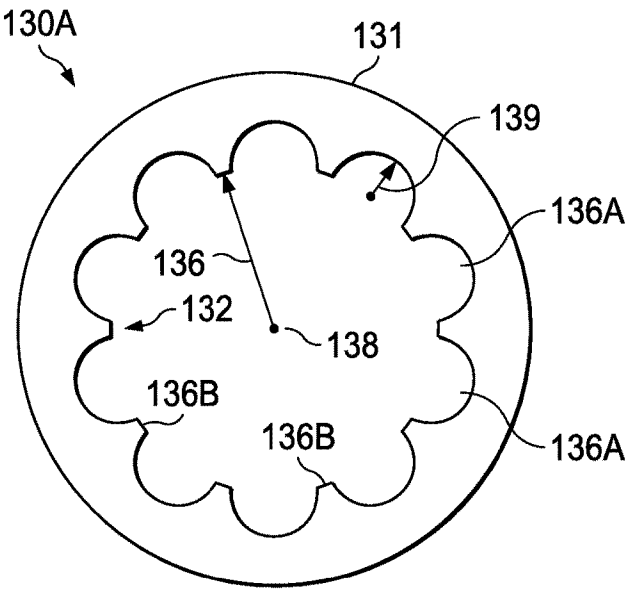
FIG. 3A illustrates a cross-sectional view of the thermionic emitter of FIG. 2, according to certain embodiments.

FIG. 2 illustrates an example thermionic emitter 130A and FIG. 3A illustrates a cross-sectional view of thermionic emitter 130A of FIG. 2, according to certain embodiments. As illustrated in these figures, thermionic emitter 130 may be in a shape of a hollow cylinder that includes an outer heated surface 131 and an inner emitter surface 132. In other embodiments, thermionic emitter 130 may be a planar emitter in the shape of a disk (e.g., FIGS. 4A-5B). Thermionic emitter 130 may be formed from any appropriate material such as tungsten, lanthanum hexaboride, barium oxide, thoriated tungsten, cerium hexaboride, and the like.

In general, outer heated surface 131 of some embodiments of thermionic emitter 130 is configured to contact an inner surface of cathode tube 120. Outer heated surface 131 is heated by an external heat source such as heater 110 in order to cause thermionic emitter 130 to emit electrons from inner emitter surface 132. Inner emitter surface 132, which is unsmooth is some embodiments, includes structures 136. Any number, arrangement, size, and shape of structures 136 may be utilized on inner emitter surface 132 in order to provide an increase in surface area to inner emitter surface 132 over a typical thermionic emitter that utilizes a smooth emitter surface (i.e., without structures 136). Various embodiments of structures 136 are discussed further below in reference to FIGS. 3B-5B. While specific numbers, arrangements, sizes, and shapes of structures 136 are illustrated herein, the disclosure is not limited to the illustrated embodiments of structures 136.

In the illustrated embodiments of FIGS. 2 and 3A, structures 136 include multiple semi-circular troughs 136A (e.g., ten semi-circular troughs 136A) and multiple ridges 136B (e.g., ten ridges 136B). Semi-circular troughs 136A generally extend from a first end 133 of thermionic emitter 130 to a second end 134 of thermionic emitter 130. Second end 134 of thermionic emitter 130 is opposite from first end 133 of thermionic emitter 130. Similarly, ridges 136B also generally extend from first end 133 of thermionic emitter 130 to second end 134 of thermionic emitter 130. Each one of ridges 136B is between two semi-circular troughs 136A. Ridges 136B may be flat (as illustrated) or may be a point in some embodiments. In some embodiments, semi-circular troughs 136A may be oval in shape rather than circular. In some embodiments, semi-circular troughs 136A may be formed by first drilling a hole with a radius 136 about a center 138 of thermionic emitter 130. Then, multiple holes with a radius 139 may be drilled about the outer circumference of the hole with radius 136 in order to form semi-circular troughs 136A. In other embodiments, these two drilling steps may be reversed. In other embodiments, any other appropriate manufacturing method may be used to form thermionic emitter 130.

FIGS. 3B-3F illustrate cross-sectional views of various alternate embodiments of thermionic emitter 130. In FIGS. 3B and 3C, structures 136 of thermionic emitters 130B and 130C include multiple rectangular troughs 136C (e.g., four rectangular troughs 136C) and multiple ridges 136B (e.g., four ridges 136B). Rectangular troughs 136C generally extend from first end 133 of thermionic emitter 130 to second end 134 of thermionic emitter 130. Each one of ridges 136B is between two of rectangular troughs 136C. Rectangular troughs 136C include a first side 301, a second side 302, and a bottom edge 303. In some embodiments, second side 302 is parallel to first side 301. In some embodiments, bottom edge 303 of each one of rectangular troughs 136C is curved (e.g., FIG. 3B). In other embodiments, bottom edge 303 of each one of rectangular troughs 136C is flat (e.g., FIG. 3C). In embodiments where bottom edge 303 is flat, bottom edge 303 may be orthogonal to both first side 301 and second side 302.

Figure 3F:
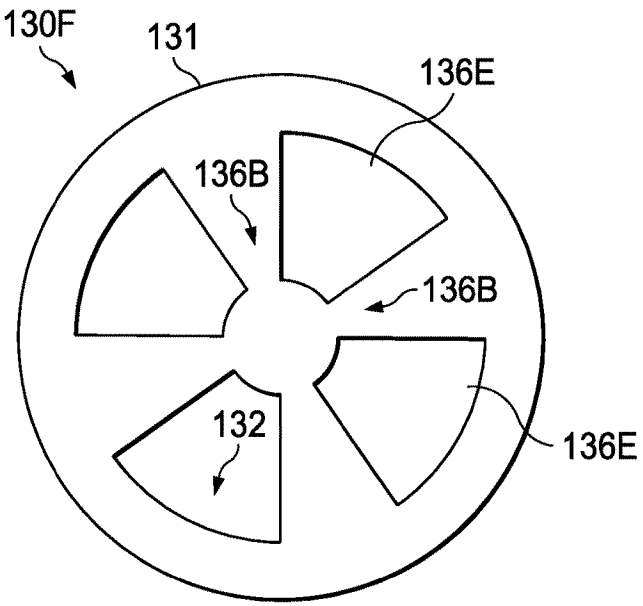
Figure 3E:
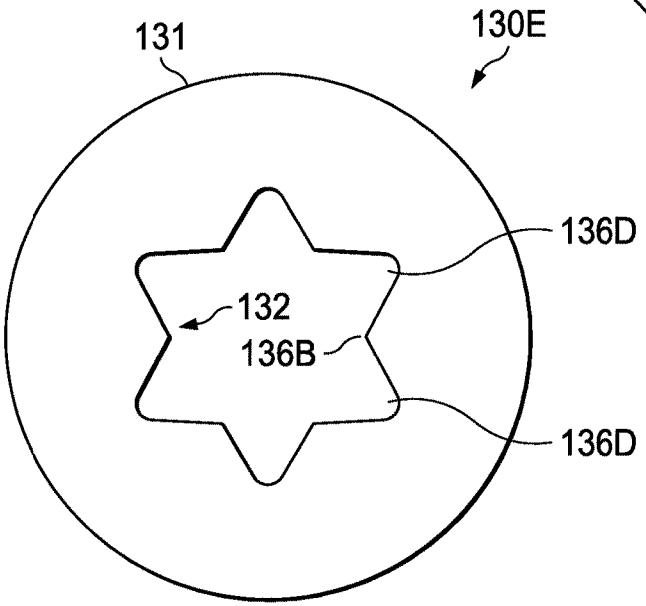
Figure 3D:
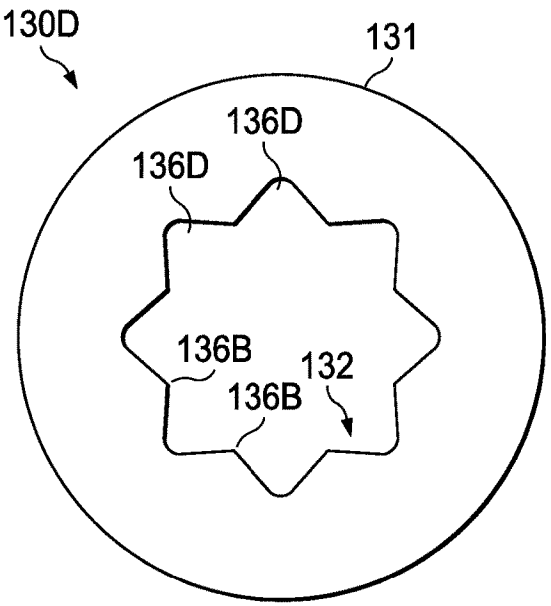

In FIGS. 3D and 3E, structures 136 of thermionic emitters 130D and 130E include multiple triangular troughs 136D (e.g., eight triangular troughs 136D in FIG. 3D and six triangular troughs 136D in FIG. 3E) and multiple ridges 136B (e.g., eight ridges 136B in FIG. 3D and six ridges 136B in FIG. 3E). Triangular troughs 136D generally extend from first end 133 of thermionic emitter 130 to second end 134 of thermionic emitter 130. Each one of ridges 136B is between two of triangular troughs 136D.

In FIG. 3F, structures 136 of thermionic emitter 130F include multiple wedges 136E (e.g., four wedges 136E) and multiple ridges 136B (e.g., four ridges 136B). Wedges 136E generally extend from first end 133 of thermionic emitter 130F to second end 134 of thermionic emitter 130F. Each one of ridges 136B is between two wedges 136E. Instead of ridges 136B being pointed or flat as illustrated in the other embodiments, ridges 136B of FIG. 3F connect to each other at a center of thermionic emitter 130. Each wedge 136E may be in any appropriate shape (e.g., triangular, square, rectangular, circular, and the like).

Figure 4A:
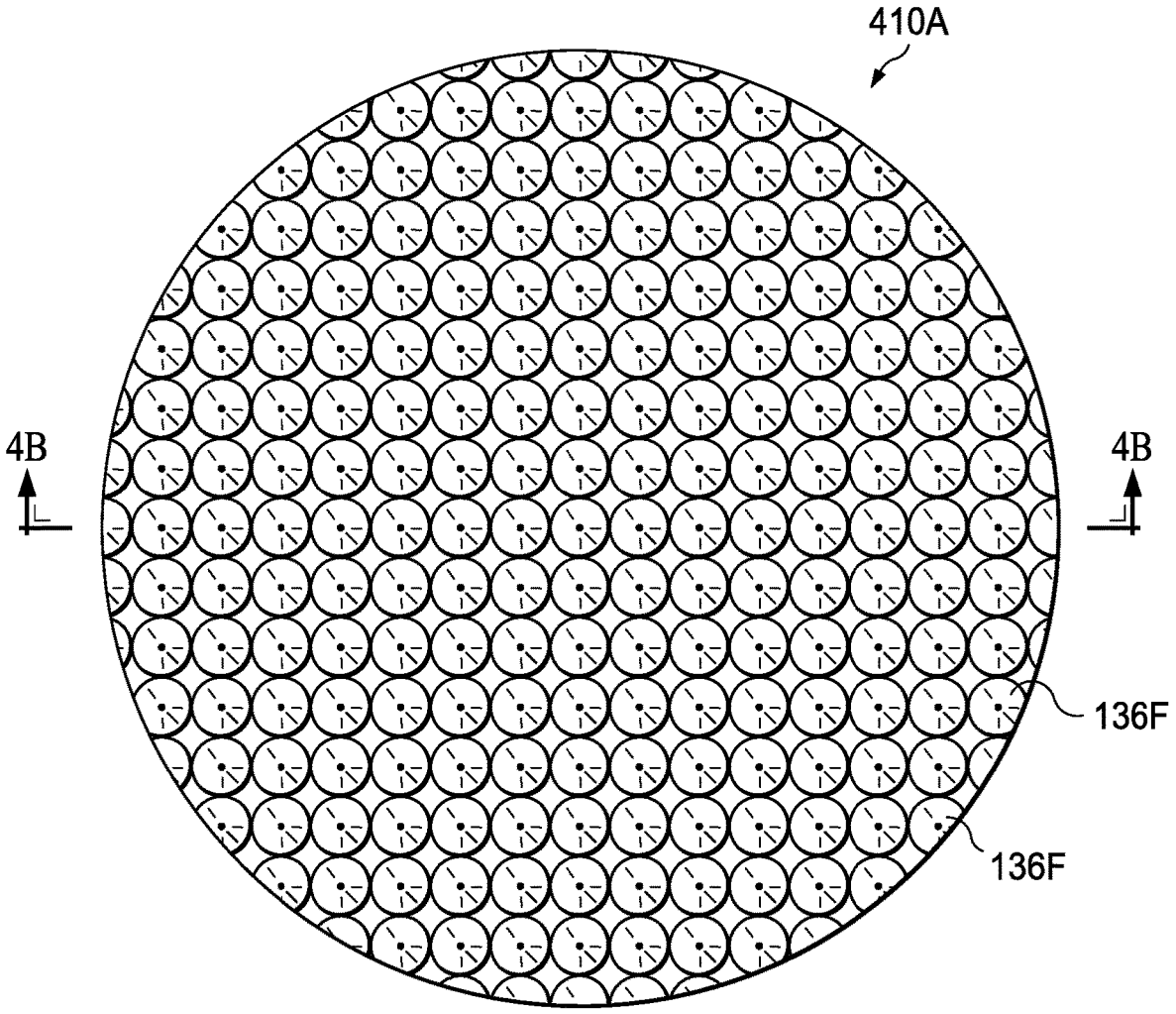
FIG. 4A illustrate a planar thermionic emitter, according to certain embodiments.
Figure 4B:
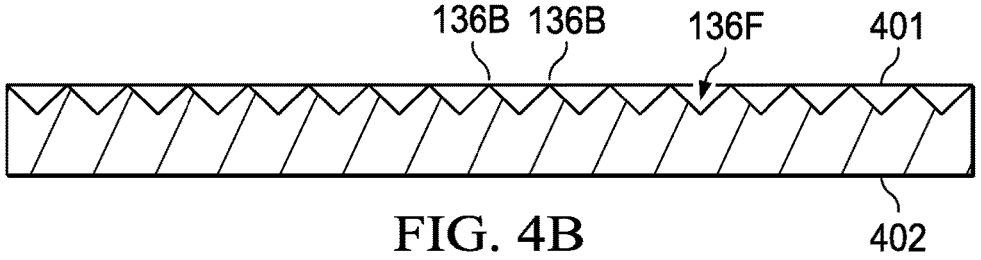
FIG. 4B illustrates a cross-sectional view of the planar thermionic emitter of FIG. 4A, according to certain embodiments.
Figure 5A:
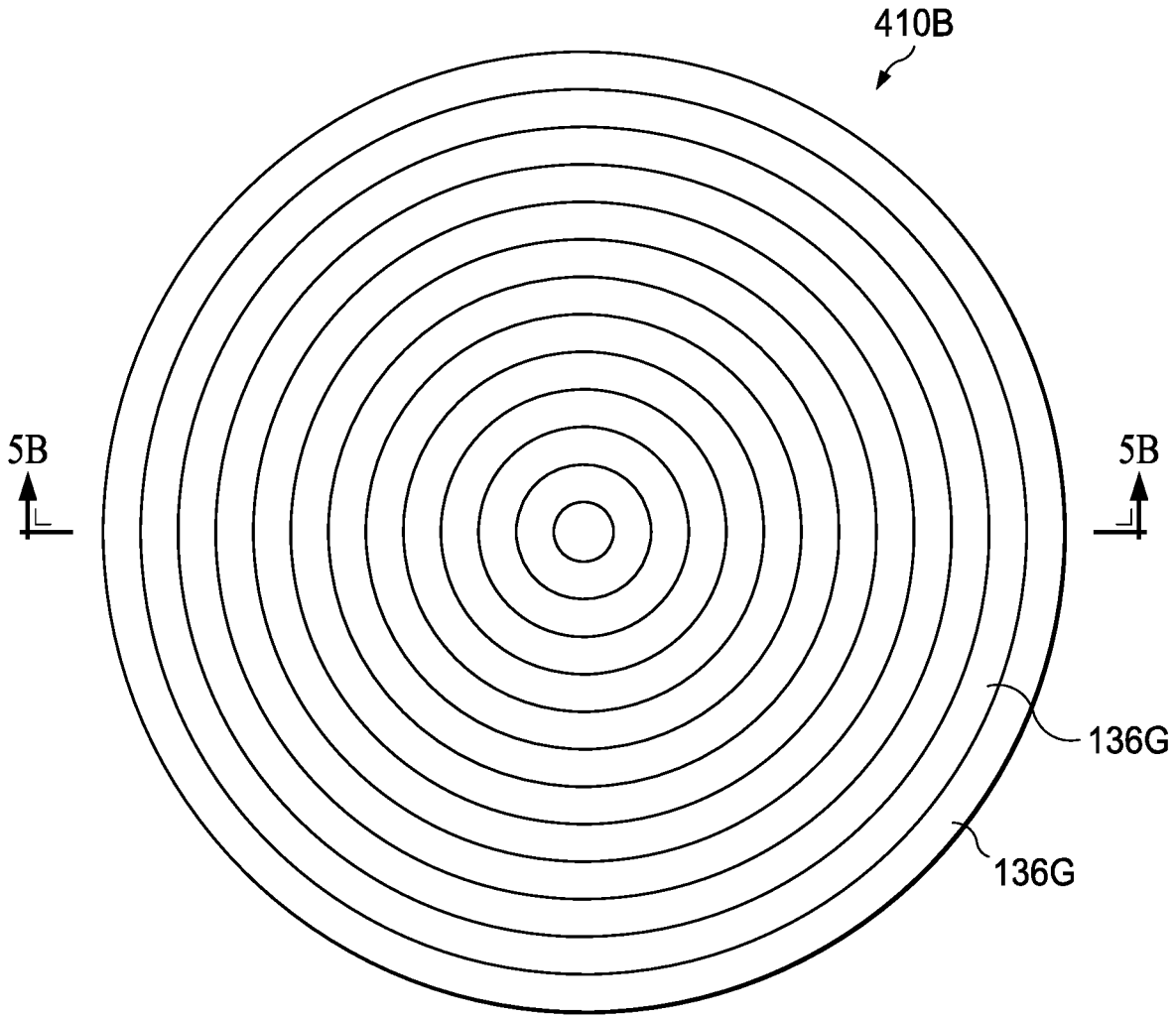
FIG. 5A illustrate another planar thermionic emitter, according to certain embodiments.
Figure 5B:
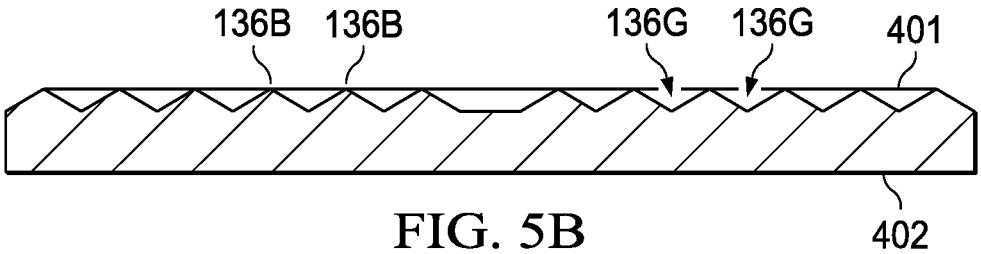
FIG. 5B illustrates a cross-sectional view of the planar thermionic emitter of FIG. 5A, according to certain embodiments.

FIGS. 4A and 5A illustrate various embodiments of a planar, disk-shaped thermionic emitter 410 (e.g., 410A and 410B). FIG. 4B illustrates a cross-sectional view of thermionic emitter 410A of FIG. 4A, and FIG. 5B illustrates a cross-sectional view of thermionic emitter 410B of FIG. 5A, according to certain embodiments. In these embodiments, thermionic emitter 410 includes a first surface 401 and a second surface 402 that is opposite first surface 401. In some embodiments, second surface 402 may be analogous to outer heated surface 131, and first surface 401 may be analogous to inner emitter surface 132. In general, first surface 401 includes multiple structures 136 that function to increase the surface area of first surface 401, thereby increasing the amount of electrons that may be emitted from first surface 401. Structures 136 may extend either below (as illustrated) or above first surface 401. In some embodiments, thermionic emitter 410 is in a shape of a circular disk. In other embodiments, thermionic emitter 410 may be in any other appropriate shape (e.g., oval, square, rectangular, etc.). Thermionic emitter 410 may be formed from any appropriate material such as those listed above in reference to thermionic emitter 130.

As illustrated in FIGS. 4A and 4B, thermionic emitter 410A includes multiple cone-shaped dimples 136F and multiple ridges 136B between cone-shaped dimples 136F. Thermionic emitter 410A may include any number and arrangement of cone-shaped dimples 136F, and cone-shaped dimples 136F may be in any appropriate shape or size. In some embodiments, cone-shaped dimples 136F may alternately be indentations of different shapes other than cones. For example, dimples 136F may be indentations that are spherical, circular, elliptical, triangular, ellipsoidal, etc. in shape.

As illustrated in FIGS. 5A and 5B, thermionic emitter 410B includes multiple concentric troughs 136G and multiple concentric ridges 136B. Each one of concentric ridges 136B is between two concentric troughs 136G. Thermionic emitter 410B may include any number and arrangement of concentric troughs 136G, and concentric troughs 136G may be in any appropriate shape or size. For example, concentric troughs 136G may be in any appropriate shape such as a triangle, square, circle, oval, ellipse, and the like.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A system, comprising:

a cathode comprising a cathode tube;

a thermionic emitter installed at least partially within the cathode tube, the thermionic emitter comprising a shape of a hollow cylinder, wherein:

the hollow cylinder comprises an outer surface and an unsmooth inner surface;

the outer surface is configured to contact an inner surface of the cathode tube;

the unsmooth inner surface comprises a plurality of structures; and the plurality of structures of the unsmooth inner surface provide an increase in surface area over a smooth surface; and a heater at least partially surrounding the cathode tube, the heater configured to heat the thermionic emitter.

2. The system of claim 1, wherein the plurality of structures of the unsmooth inner surface comprises:

a plurality of semi-circular troughs that extend from a first end of the thermionic emitter to a second end of the thermionic emitter that is opposite the first end; and a plurality of ridges that extend from the first end of the thermionic emitter to the second end of the thermionic emitter, wherein each one of the plurality of ridges is between two of the plurality of semi-circular troughs.

3. The system of claim 1, wherein the plurality of structures of the unsmooth inner surface comprises:

a plurality of triangular troughs that extend from a first end of the thermionic emitter to a second end of the thermionic emitter that is opposite the first end; and a plurality of ridges that extend from the first end of the thermionic emitter to the second end of the thermionic emitter, wherein each one of the plurality of ridges is between two of the plurality of triangular troughs.

4. The system of claim 1, wherein the plurality of structures of the unsmooth inner surface comprises:

a plurality of rectangular troughs that extend from a first end of the thermionic emitter to a second end of the thermionic emitter that is opposite the first end, each one of the plurality of troughs comprising:

a first side;

a second side that is parallel to the first side; and a bottom edge;

a plurality of ridges that extend from the first end of the thermionic emitter to the second end of the thermionic emitter, wherein each one of the plurality of ridges is between two of the plurality of rectangular troughs.

5. The system of claim 4, wherein the bottom edge of each one of the plurality of rectangular troughs is curved.

6. The system of claim 4, wherein:

the bottom edge of each respective rectangular trough is flat; and the bottom edge of each respective rectangular trough is orthogonal to the first and second sides of the respective rectangular trough.

7. The system of claim 1, wherein the thermionic emitter is formed from a material selected from the group consisting of:

tungsten;

thoriated tungsten;

lanthanum hexaboride;

barium oxide; and cerium hexaboride.

8. A system, comprising:

a cathode comprising a cathode tube;

a thermionic emitter installed at least partially within the cathode tube, the thermionic emitter comprising a shape of a hollow cylinder, wherein:

the hollow cylinder comprises an outer surface and an inner surface; and the inner surface comprises a plurality of structures extending below or above the inner surface; and a heater at least partially surrounding the cathode tube, the heater configured to heat the thermionic emitter.

9. The system of claim 8, wherein the plurality of structures of the inner surface comprises:

a plurality of semi-circular troughs that extend from a first end of the thermionic emitter to a second end of the thermionic emitter that is opposite the first end; and a plurality of ridges that extend from the first end of the thermionic emitter to the second end of the thermionic emitter, wherein each one of the plurality of ridges is between two of the plurality of semi-circular troughs.

10. The system of claim 8, wherein the plurality of structures of the inner surface comprises:

a plurality of triangular troughs that extend from a first end of the thermionic emitter to a second end of the thermionic emitter that is opposite the first end; and a plurality of ridges that extend from the first end of the thermionic emitter to the second end of the thermionic emitter, wherein each one of the plurality of ridges is between two of the plurality of triangular troughs.

11. The system of claim 8, wherein the plurality of structures of the inner surface comprises:

a plurality of rectangular troughs that extend from a first end of the thermionic emitter to a second end of the thermionic emitter that is opposite the first end, each one of the plurality of rectangular troughs comprising:

a first side;

a second side that is parallel to the first side; and a bottom edge;

a plurality of ridges that extend from the first end of the thermionic emitter to the second end of the thermionic emitter, wherein each one of the plurality of ridges is between two of the plurality of rectangular troughs.

12. The system of claim 11, wherein the bottom edge of each one of the plurality of rectangular troughs is curved.

13. The system of claim 11, wherein:

the bottom edge of each respective rectangular trough is flat; and the bottom edge of each respective rectangular trough is orthogonal to the first and second sides of the respective trough.

14. The system of claim 8, wherein the thermionic emitter is formed from a material selected from the group consisting of:

tungsten;

thoriated tungsten;

lanthanum hexaboride;

barium oxide; and cerium hexaboride.

15. A thermionic emitter in a shape of a hollow cylinder, the thermionic emitter comprising:

an inner surface of the cylinder;

an outer surface of the cylinder that is opposite the inner surface; and a plurality of structures within the inner surface of the hollow cylinder, the plurality of structures comprising:

a plurality of wedges that extend from a first end of the cylinder to a second end of the cylinder that is opposite the first end; and a center portion that extends from the first end of the cylinder to the second end of the cylinder, wherein each one of the plurality of wedges is coupled to the center portion.

* * * * *